United States Patent [19]

Kuno et al.

[11] Patent Number: 4,887,522

[45] Date of Patent: Dec. 19, 1989

[54] AIR-CONDITIONING APPARATUS

[75] Inventors: Toshio Kuno; Yoshikazu Shindo; Yukio Kuno; Takeshi Ueno, all of Fukuoka; Akira Torimi, Saga; Yoji Mori, Fukuoka, all of Japan

[73] Assignee: Kabushiki Kaisha Kyoritsu, Oaza Wada, Japan

[21] Appl. No.: 184,013

[22] Filed: Apr. 20, 1988

[30] Foreign Application Priority Data

| | | | |
|---|---|---|---|
| May 22, 1987 | [JP] | Japan | 62-77574[U] |
| Jul. 16, 1987 | [JP] | Japan | 62-178648 |
| Sep. 8, 1987 | [JP] | Japan | 62-137868[U] |
| Sep. 26, 1987 | [JP] | Japan | 62-147426[U] |
| Oct. 19, 1987 | [JP] | Japan | 62-160641[U] |
| Feb. 10, 1988 | [JP] | Japan | 62-29338 |

[51] Int. Cl.[4] ..... F24F 13/14

[52] U.S. Cl. ..... 98/40.2; 98/40.24; 98/41.1; 98/121.1; 98/121.2; 137/298; 138/39; 138/45

[58] Field of Search ..... 98/40.2, 40.24, 41.1, 98/110, 121.1, 121.2, ; 137/298; 138/37, 39, 45, 46

[56] References Cited

U.S. PATENT DOCUMENTS

| | | | |
|---|---|---|---|
| 2,021,086 | 11/1935 | Oskamp | 48/121.1 X |
| 2,222,081 | 11/1940 | Leigh | 48/40.2 X |
| 2,366,224 | 1/1945 | Warp | 98/121.1 |
| 2,381,345 | 8/1945 | Greenlaw | 98/40.2 |
| 2,656,780 | 10/1953 | Spieth | 98/40.2 |
| 2,705,973 | 4/1955 | Rice | 138/39 |
| 2,784,659 | 3/1957 | De Roo et al. | 98/40.2 |
| 3,964,875 | 6/1976 | Chang et al. | 138/42 X |

FOREIGN PATENT DOCUMENTS

| | | | |
|---|---|---|---|
| 487982 | 11/1952 | Canada | 98/40.2 |

*Primary Examiner*—Harold Joyce

*Attorney, Agent, or Firm*—Cushman, Darby & Cushman

[57] ABSTRACT

An air-conditioning apparatus for adjusting the direction and quantity of air comprises a duct device forming an air passage passing through the duct device, and an airflow adjusting device. The airflow adjusting device is made from a single thin plate and fitted to the duct device across the air passage to adjust a flow of air. Slits of predetermined patterns are formed on the airflow adjusting device to define a plurality of vanes which are integral to the airflow adjusting device.

6 Claims, 19 Drawing Sheets

PRIOR ART FIG 18
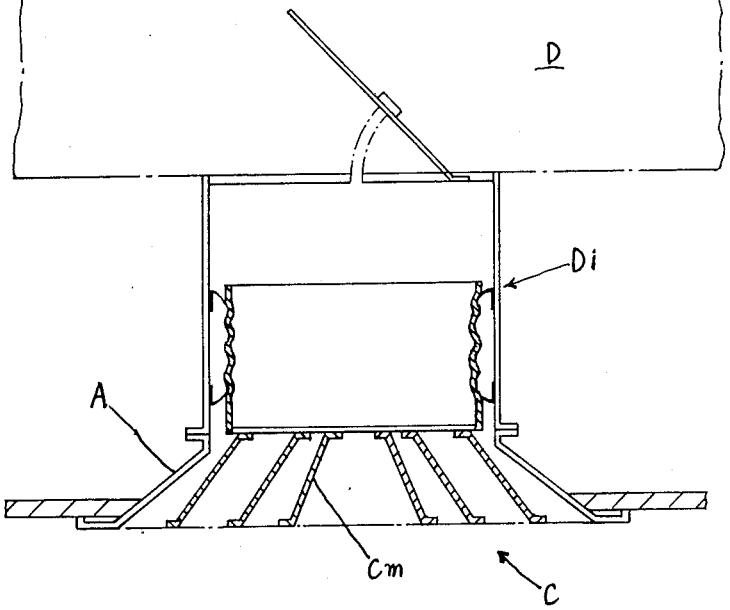
PRIOR ART FIG 19
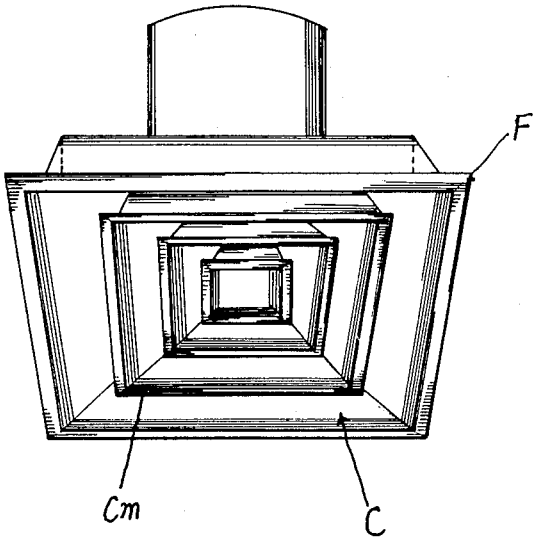

FIG 24
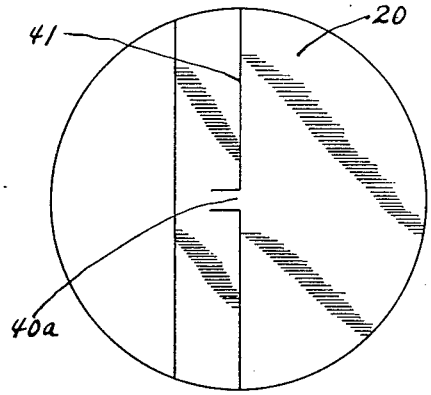
PRIOR ART FIG 25
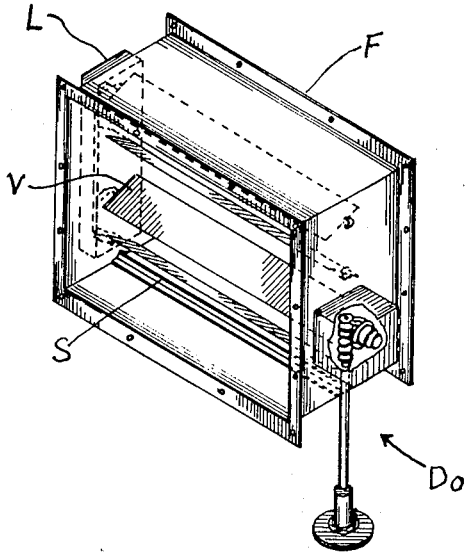
FIG 26
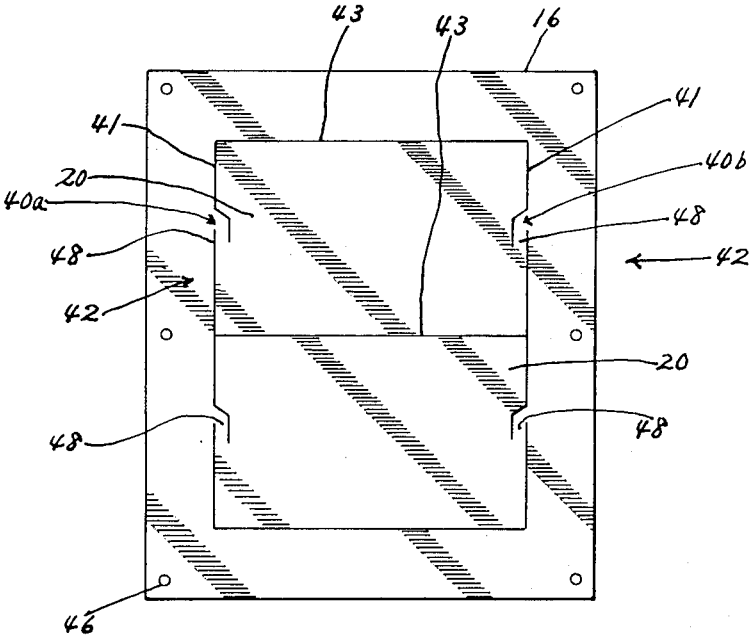

AIR-CONDITIONING APPARATUS

BACKGROUND OF THE INVENTION

1. Field of the Invention

The present invention relates to an air-conditioning apparatus used as a supply outlet or an air-conditioning damper to adjust the direction and quantity of air.

2. Description of the Prior Art (a) To maintain air in a building at good conditions, it is general to arrange air-conditioning ducts above a ceiling of the building and supply outlets fitted to openings formed on the ceiling at proper locations. Air with properly conditioned temperature and humidity is supplied through the supply outlets to an interior of the building to control conditions of the interior properly.

FIGS. 18 and 19 show an example of an air-conditioning apparatus according to a prior art. An intermediate duct D is arranged above a ceiling, and a terminating duct Di is connected to the intermediate duct D. The terminating duct Di has a space A of a pyramid frustum shape whose broadening portion is oriented to an opening formed on the ceiling. Inside the space A, there is disposed a cone portion C which is movable up and down. The cone portion C comprises a plurality of cones Cm having different sectional areas respectively and concentrically installed to uniformly supply air to an interior under the ceiling.

One drawback of this type of air-conditioning apparatus is that the cone portion C is hardly removed from the space A and, therefore, the direction of an airflow is determined by the constitution of the cone portion C once the terminating duct Di and cone portion C are installed to the ceiling. Therefore, it is difficult to adjust the airflow according to the interior conditions.

The cones Cm are fixed in the cone portion C, i.e., the cones Cm are not movable in the cone portion C, once the terminating duct Di and cone portion C are installed. Therefore, it is impossible to finely adjust angles of the airflow depending on the conditions in the interior.

Further, the cones Cm shall be manufactured separately and assembled and fixed concentrically to form the cone portion C so that they require many manufacturing processes to increase manufacturing and material costs.

Meanwhile, because of diversified values under a current ripe culture background, it is needed to consider a total design of an interior. Therefore, it may be required to provide color patterns and designs on outlets of the air-conditioning apparatus. The prior art outlet described in the above is not adequate to provide the design patterns or elaborate designs on its surface exposed to the interior of the building because the prior art outlet is fixed and not adjustable freely.

Since the corn portion C shall be movable up and down to adjust air supplying angles, it is necessary to provide a stopping mechanism for the outlet.

(b) To adjust the quantity of air flowing through an air-conditioning duct, it is known to interpose a damper in the middle of the duct. The damper has vanes which are closed and opened to adjust the quantity of air flowing through the duct.

FIG. 25 is a perspective view schematically showing the constitution of an air quantity adjusting damper according to a prior art. The damper comprises a box-like frame F having a predetermined width in an air flowing direction, rotary shafts S supported by bearings disposed in the frame F, vanes V fixed to the rotary shafts S respectively and rotatable with the rotary shafts S to open and close ventilating openings in the frame F, a linkage L for linking the vanes to each other to simultaneously drive them for predetermined angles, and an external driving mechanism Do composed of a handle and a warm gear mechanism connected to one of the rotary shafts to externally open and close the vanes.

Compared to its simple task to correctly adjust the air quantity, this kind of damper has drawbacks that it has a complicate structure and many parts due to the linkage and external driving mechanisms to increase costs, and that the vanes are difficult to adjust to optional angles separately depending on situations on the downstream side.

(c) An air-conditioning duct tends to be disposed at right angles or curved depending on the structure of a building. At such a nonlinear portion, an elbow is formed where a problem of pressure loss is caused. To cope with this problem and secure a uniform airflow, guide vanes are disposed at the elbow. Generally, the guide vanes are assembled fixedly in a solid frame.

The curvature and pitch of the guide vanes are determined according to the shape, cross-sectional area and curvature of the elbow, and, according to these conditions, the guide vanes are welded and assembled to a solid frame. These welding and assembling works are complicated and take a long time. Further, it is difficult to make the elbow with the guide vanes accurately to meet the conditions of the duct. In addition, material cost is relatively high because the guide vanes are separately attached to the solid frame.

SUMMARY OF THE INVENTION

To cope with the problems of the prior arts mentioned in the above, a first object of the present invention is to provide an air-conditioning apparatus to be used as a supply outlet which has a remarkably simple structure, its air supplying direction being optionally adjustable even after the installation of the apparatus, respective vanes of the apparatus being able to be separately, optionally and finely adjustable to improve adjustability of the direction and distribution of air, and manufacturing and material costs of the apparatus being remarkably reduced. The apparatus enables various design patterns to be provided on part of the apparatus exposed to an interior. Further, the apparatus eliminates the need of a stopping mechanism, thus improving functionality and practicability.

A second object of the present invention is to provide an air-conditioning apparatus to be used as an airflow adjusting damper which has a simple structure to remarkably reduce costs, make the design, installation, transportation and maintenance of the apparatus easier, and vanes of the apparatus being able to be separately adjustable to optional angles.

A third object of the present invention is to provide an air-conditioning apparatus to be used as a guide vane apparatus which is easy to manufacture, install and adjust its angles in a short time, and realized with low material costs.

According to a first aspect of the present invention, there is provided an air-conditioning apparatus to be used as a supply outlet. The supply outlet does not have the cone portion of the prior art air-conditioning apparatus which is constituted integrally to the opening of the prior art apparatus. The supply outlet of the present invention is very simple in its constitution and enables an airflow direction to be optionally adjusted even after the installation of the supply outlet. Angles of respective vanes of the supply outlet can be independently, optionally and finely adjusted to improve adjustability of the direction and distribution of air. The simple structure of the supply outlet may remarkably reduce the costs of manufacturing and material. Further, the supply outlet does not need the stopping mechanism for the movable cone portion of the prior art apparatus.

According to this aspect of the present invention, slits are cut on a thin plate to define the vanes of the supply outlet, and color designs may be freely drawn on the vanes to provide design patterns to part of the supply outlet to be exposed to the interior of a building, thus improving a design effect of the interior to meet total design requirements.

Since the supply outlet is removably attached to an opening of the air-conditioning apparatus open to a human living space, the supply outlet may be replaced with another one having a different design matching with a current season.

According to a second aspect of the present invention, there is provided an air-conditioning apparatus to be used as an air-conditioning damper. The damper can be automatically mass-produced to remarkably reduce process costs. Since the external driving mechanism and linkage for driving the vanes of the prior art air-conditioning apparatus are not needed, costs are remarkably reduced. Angles of respective vanes of the damper can be separately and optionally adjusted so that a user can adjust an airflow at need.

To form the vanes of the damper integrally on a single thin plate, slits are cut on the plate. Since the adjacent sides of adjacent vanes are defined with a single slit, only the vanes interfere with an air passage so that no pressure loss is caused, and an air quantity efficiently adjusted.

Since the damper is constituted with the thin plate, the total weight of the damper is very light and not bulky so that the damper is easy to handle, store and transport.

The damper is easily fitted to and removed from a duct to reduce a working time and a time loss and eliminate laborsome work.

The vanes of the damper are pivotable and adjustable even if supporting portions of the vanes are rusted.

According to a third aspect of the present invention, there is provided an air-conditioning apparatus to be used as a guide vane apparatus which is easy to manufacture, adjusted and assembled in a short time, highly accurate to reduce pressure loss and effective to correct an airflow. Further, the guide vane apparatus can be manufactured at a low material cost.

In order to accomplish the objects and advantages mentioned in the above, the present invention provides an air-conditioning apparatus for adjusting the direction and quantity of air. The apparatus comprises a duct member forming an air guiding passage passing through the duct member, and an airflow adjuster fitted to the duct member and made from a single thin plate to adjust a flow of air. The airflow adjuster has slits of predetermined patterns, the slits defining a plurality of vanes integral to the thin plate.

BRIEF DESCRIPTION OF THE DRAWINGS

FIG. 18 is a cross-sectional view schematically showing a supply outlet according to a prior art;

FIG. 19 is a perspective view showing the prior art supply outlet shown in FIG. 18;

FIG. 24 is an explanatory view showing essential part of slits with extensions extending only in a parting direction;

FIG. 25 is a perspective view schematically showing an airflow adjusting damper according to a prior art;

FIG. 26 is a front view schematically showing an airflow adjuster according to an embodiment 2—2 of the present invention in which thin connections are formed in parallel with slits for a first side pair;

DETAILED DESCRIPTION OF THE EMBODIMENTS

Preferred embodiments of the present invention will be described with reference to the accompanying drawings.

(First Embodiment)

FIGS. 1 to 15 show air-conditioning apparatuses used as supply outlets according to the preferred embodiments of the present invention.

Figure 1:
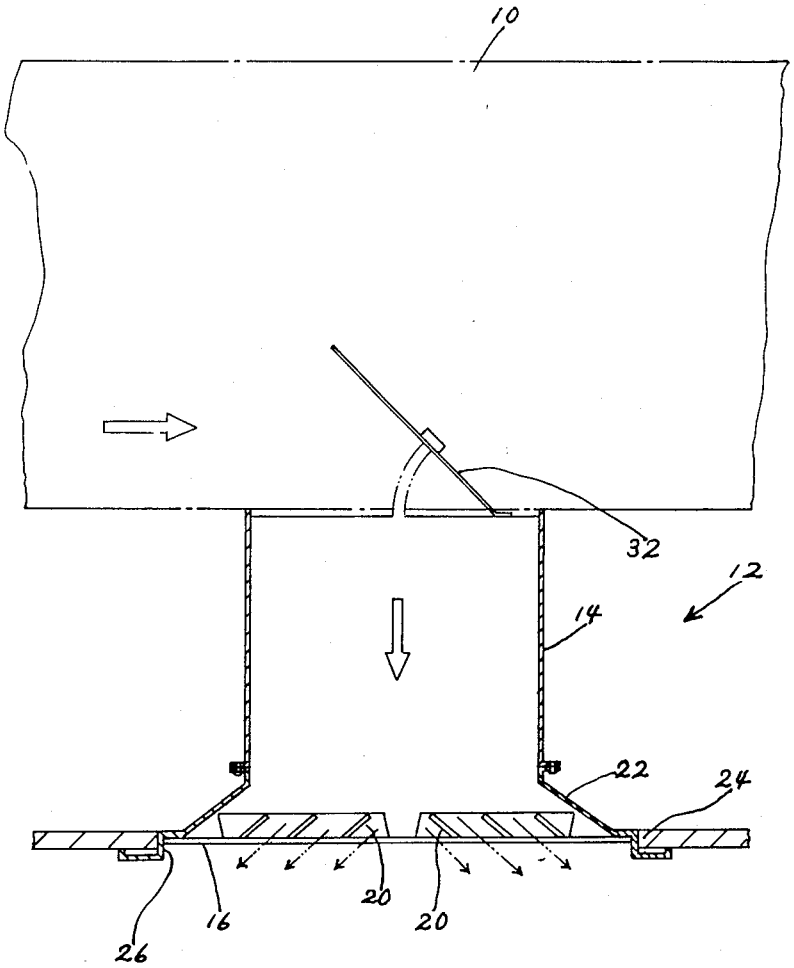
FIG. 1 is a sectional view schematically showing an air-conditioning apparatus used as a supply outlet according to a first embodiment of the present invention.

In FIG. 1, an air-conditioning intermediate duct 10 is disposed above a ceiling of a building. At a proper location of the intermediate duct 10, an air-conditioning apparatus 12 of the present invention is connected to the intermediate duct 10 to communicate air between them.

The air-conditioning apparatus 12 is to adjust the direction and quantity of air, and comprises a duct member 14 forming an air guiding passage passing through the duct member 14, and an airflow adjuster 16 fitted to the duct member 14 across the air passage.

The duct member 14 is a terminating duct connected to the intermediate duct 10 to guide air to a human living space such as a room and a corridor.

Figure 2:
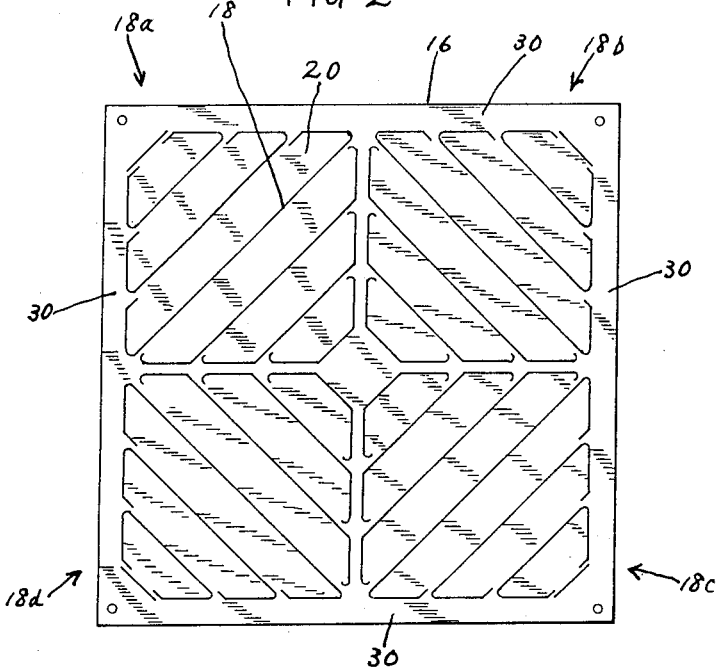
FIG. 2 is a view schematically explaining the constitution of slits of an airflow adjuster.

The airflow adjuster 16 is made from a single thin plate made of soft steel and has slits 18 of predetermined patterns as shown in FIG. 2.

The airflow adjuster 16 has vanes 20 defined with the slits 18.

The duct member 14 has substantially a rectangular cross-section and is provided with an opening 22 which is open to the human living space such as a room, a corridor, and a space in a theater or a factory. Namely, an end portion of the duct member 14 is formed in a pyramid frustum whose broadening portion is open to a rectangular opening 24 formed on the ceiling. An area of the opening 22 is substantially the same as that of the opening 24 formed on the ceiling.

At an edge portion of the opening 22 where it is tightly connected to the opening 24 of the ceiling, the opening 22 forms a step-like positioning section 26. To this positioning section 26, the airflow adjuster 16 is fixed with screws to close the opening 22.

The airflow adjuster 16 is not only fixed to the positioning section 26 with the screws but also removably fitted to the positioning section 26 with magnet plates which may be fixed to the positioning section 26 or to an inner periphery of the airflow adjuster 16.

The opening 22 provided to the end of the duct member 14 is exposed to the human living space, and the positioning section 26 is provided at the opening 22. The airflow adjuster 16 is removably fitted to the positioning section 26 so that the airflow adjuster 16 can be easily replaced with another one having desired slit patterns to change air flowing directions and design effects at need.

Not like the prior art air-conditioning apparatus which has the cones separately formed and fixed to the opening of the duct member, the airflow adjuster 16 of the present invention is removably fitted to the duct member 14 so that the supplying direction of conditioned air can be freely changed even after the installation of the airflow adjuster 16. Moreover, angles of the respective vanes of the airflow adjuster 16 can be easily changed manually so that the direction and distribution of air can be adjusted freely.

Figure 3:
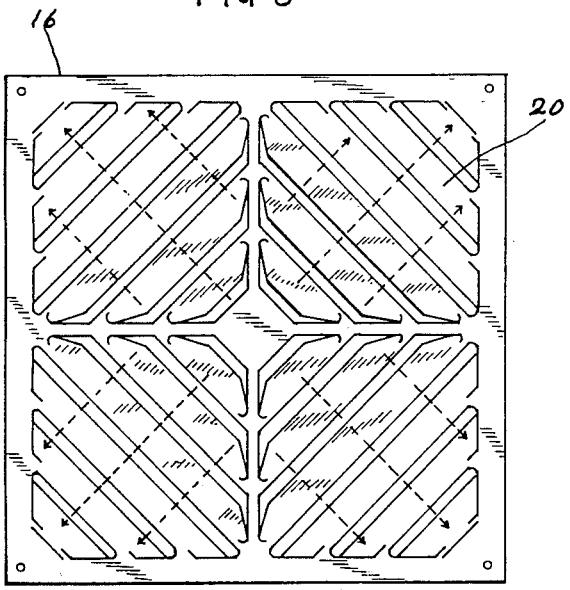
FIG. 3 is an explanatory view showing the airflow adjuster with vanes raised seen from the inside of an interior where the airflow adjuster is installed.
Figure 4:
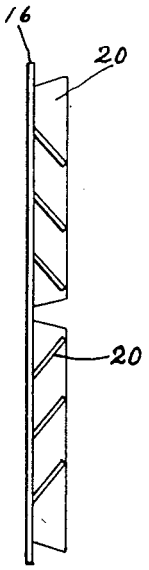
FIG. 4 is a side view showing the airflow adjuster.
Figure 5:
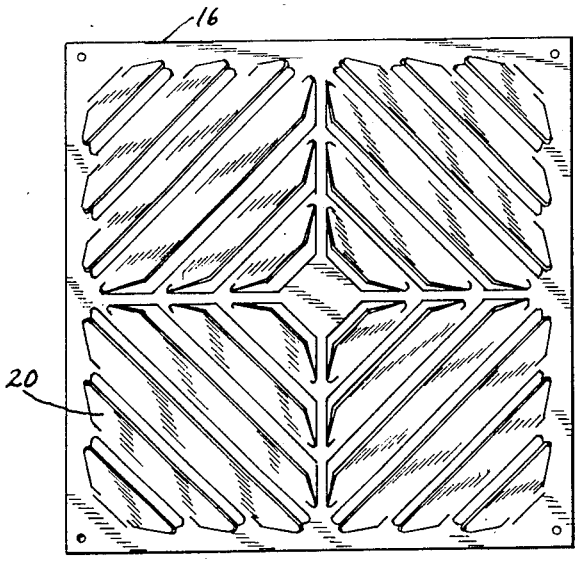
FIG. 5 is an explanatory view showing the airflow adjuster shown in FIG. 3 but seen from an intermediate duct to which the airflow adjuster is attached.

FIG. 2 is a view schematically showing the constitution of the airflow adjuster 16. The airflow adjuster 16 has the slits 18 of different patterns cut on the single thin plate made of soft steel to define contours of the plural vanes 20 integral to the thin plate. As shown in FIGS. 3 and 4, the vanes 20 are raised to form air passages.

According to this embodiment, the airflow adjuster 16 is in a rectangular shape and orthogonally divided into four segments. Namely, the airflow adjuster 16 comprises a separating portion 28 and a peripheral portion 30 to form four separate slit groups 18*a*, 18*b*, 18*c* and 18*d* surrounded by the portions 28 and 30.

As shown in the figure, each slit group has a plurality of slits extending in the same direction. An extending direction of the slits in one slit group differs from those of the other slit groups. Namely, the slit groups are cut such that the groups supply air toward four corners respectively. As shown in the figure, a slit on the raised side of a vane is cut orthogonal to dotted lines extending between the center and each corner of the plate to provide an airflow in a direction of arrow marks indicated with the dotted lines.

The slits are cut with a laser process, a plasma process or a pressing process to form slits of optional patterns.

Since the angles of the respective vanes 20 are easily set manually, the vanes will be worked out easily. Even after the airflow adjuster 16 is fitted to the opening 22, an air supplying angle of the airflow adjuster 16 can be easily changed to a desired value by a person to whom conditioned air is supplied.

The airflow adjuster 16 is removable to clean the vanes 20 so that the maintenance of an air supplying port of the air-conditioning apparatus may be completely carried out.

The airflow adjuster 16 removably fitted to the opening 22 is light so that it is easy to install the airflow adjuster 16 to the position.

The stopping mechanism for stopping the cone portion indispensable for the conventional air-conditioning apparatus is not needed in the present invention where the air supplying angle is adjustable with the airflow adjuster 16 fitted to the opening 22 of the duct member 14.

The airflow adjuster 16 with the vanes 20 defined with the slits integrally to the adjuster is removably fitted to the opening 22 so that the supporting and reinforcing members required for the cone portion of the conventional air-conditioning apparatus are completely eliminated. As a result, pressure loss is reduced, an air flow quantity increased and a radius of airflow diffusion remarkably increased. Therefore, compared to the conventional supply outlet, the present invention will increase a processible air quantity to reduce an area of the opening.

The present invention does not need the internal supporting frames and reinforcing members required for the cone portion of the conventional air-conditioning apparatus so that noises are remarkably reduced in the present invention.

Since the airflow adjuster 16 is constituted by a single thin plate on which slits of various patterns are made, the airflow adjuster 16 can provide an excellent design effect on the basis of interior upholstering.

Figure 6:
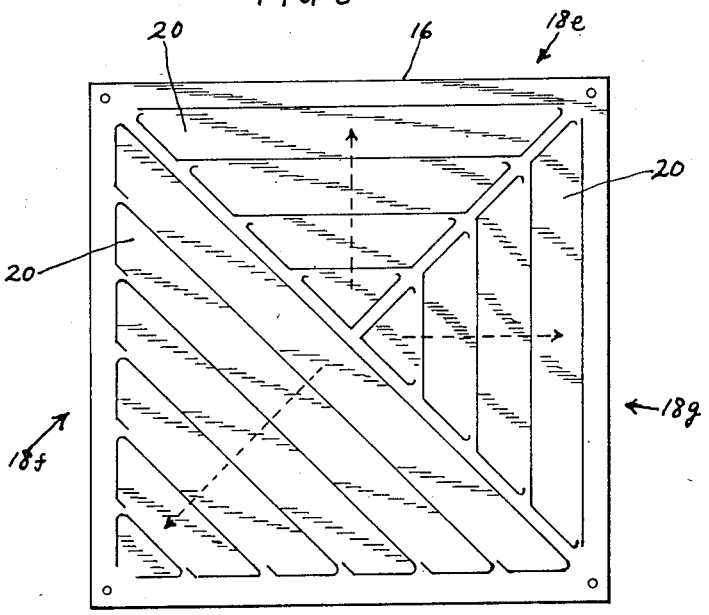
FIGS. 6 to 8 are views showing slit patterns respectively for diffusing air in three directions.
Figure 7:
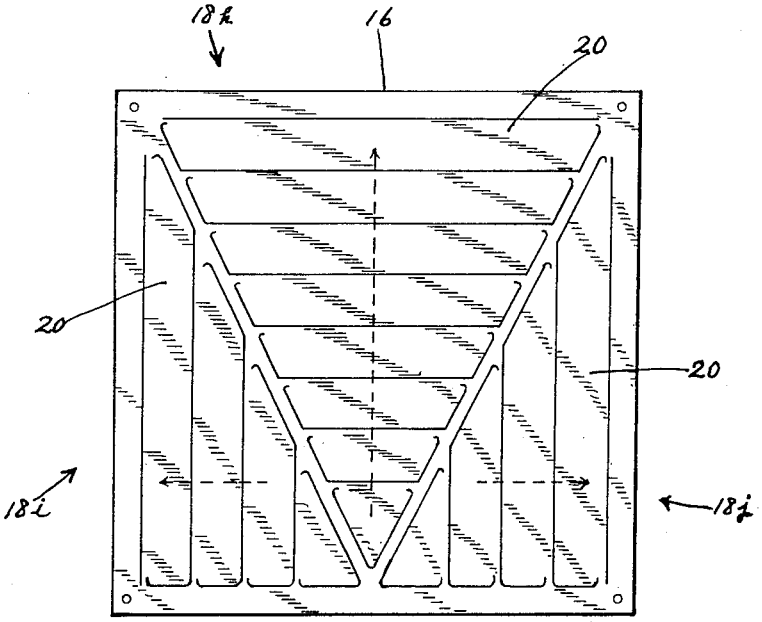
Figure 8:
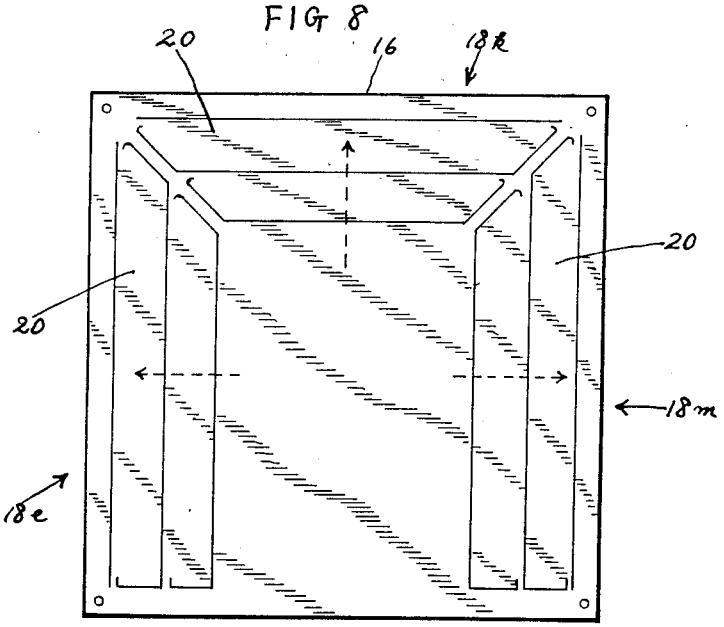

FIGS. 6 to 8 show slit patterns to diffuse air in three directions. In the figures, slits 18 comprise three kinds of slit groups (18*e*, 18*f*, 18*g*), (18*h*, 18*i*, 18*j*) and (18*k*, 18*l*, 18*m*) respectively. As indicated with dotted lines, the tree slit groups provide three different air diffusing directions respectively.

Figure 9:
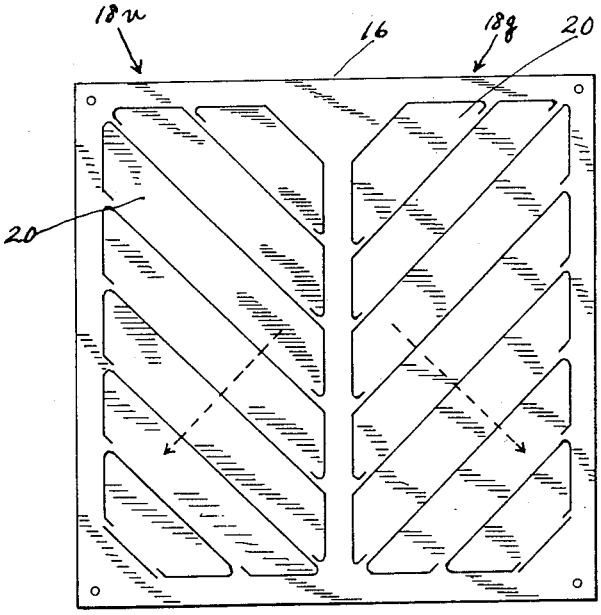
FIGS. 9 to 12 are views showing slit patterns respectively for diffusing air in two directions.
Figure 12:
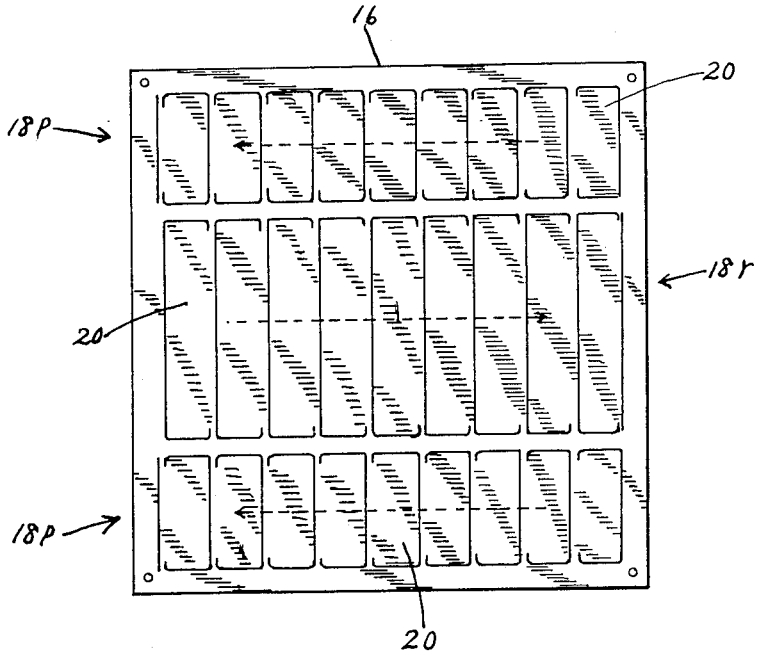

FIGS. 9 and 12 show slit patterns to diffuse air in two directions. As apparent from the figures, first slit groups 18*n* and 18*p* extend in one direction while second slit groups 18*q* and 18*r* extend in another direction different from the one direction.

Figure 11:
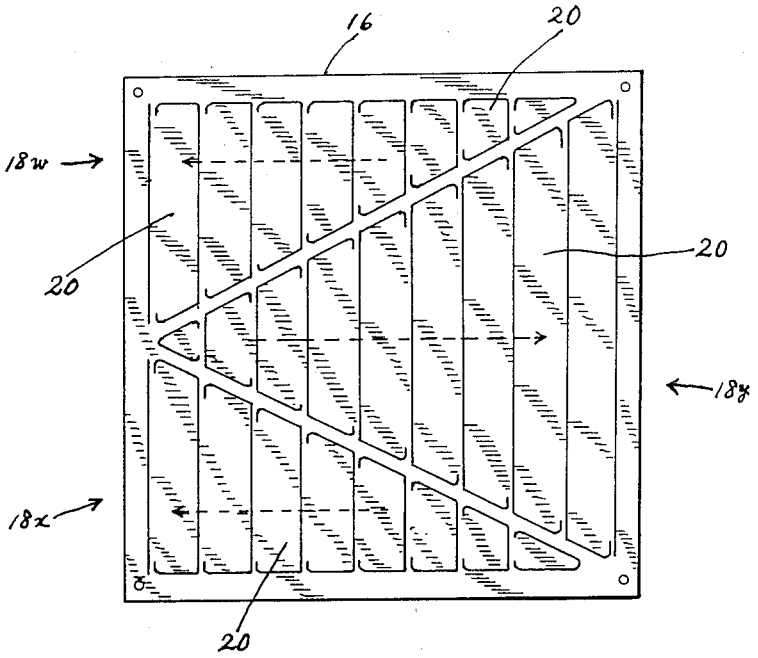

FIG. 11 shows slit patterns to diffuse air in two directions. The predetermined slit patterns comprise three kinds of slit groups 18*w*, 18*x* and 18*y* extending in the same direction.

Figure 10:
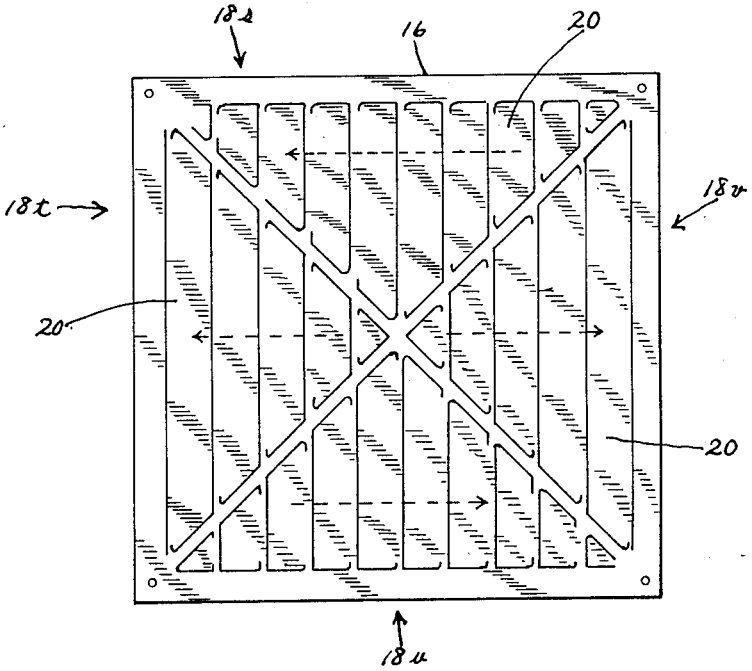

FIG. 10 shows slit patterns to diffuse air in two directions. The predetermined slit patterns comprise four kinds of slit groups 18*s*, 18*t*, 18*u* and 18*v* extending in the same direction.

Figure 13:
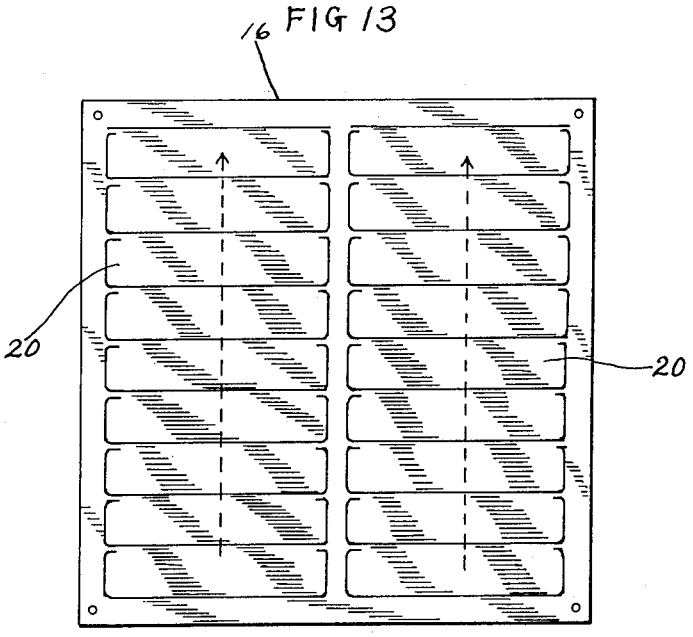
FIG. 13 is a view showing a slit pattern for diffusing air in one direction.

FIG. 13 shows two groups of slit patterns which are extending in the same direction to diffuse air in one direction only.

According to the embodiments of the present invention, it is possible to freely draw color patterns on the airflow adjuster 16 before fixing the airflow adjuster 16 to the opening 22. As a result, the airflow adjuster 16 can satisfy the taste and feeling of a user, and it is possible to provide a variety of designs on the supply outlet, thereby improving design effects of the apparatus to meet the atmosphere, quality and total design of an interior.

When the apparatus of the present invention is attached to a unit ceiling, they may be easily transported from a factory because the apparatus of the present invention is light.

The airflow adjuster 16 can be replaced with another one having slit patterns matching with a current season to easily change the air flowing direction and design effects of the apparatus.

In the supply outlet shown in FIG. 1, conditioned air flowing through the intermediate duct 10 from the left to the right in the figure reaches the duct member 14 through an air intake plate 32. The air is passed to the broadening portion of the opening 22 and diffused into an interior through the vanes 20.

Depending on a person's seating situation and a desired airflow distribution in the interior, opening degrees of the vanes 20 can be separately adjusted manually to finely adjust the air supplying angles and airflow distribution.

If it is needed to change the air supplying direction after the installation of the supply outlet, the airflow adjuster 16 can be replaced with another one by unfastening and fastening screws, thus easily realizing a required airflow direction.

Figure 14:
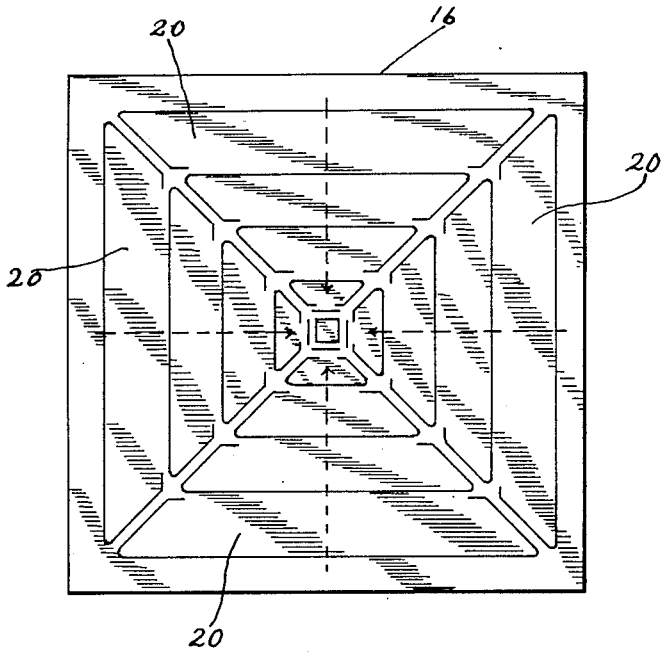
FIG. 14 is a plan view showing an airflow adjuster used as a supply outlet for a spot air conditioning.
Figure 15:
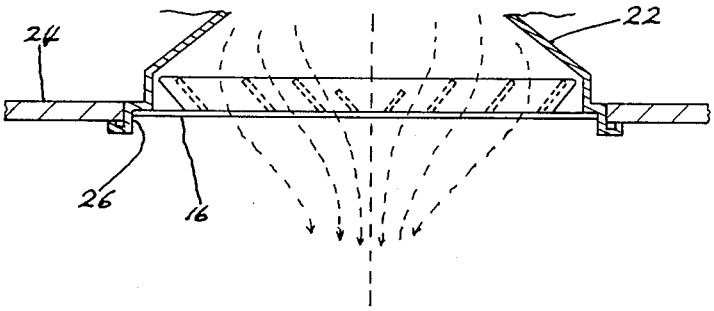
FIG. 15 is a cross-sectional view showing the airflow adjuster shown in FIG. 14.

As shown in FIGS. 14 and 15, slits may be cut to define vanes realizing an airflow toward the center. In this case, the air-conditioning apparatus can be used as a supply outlet for spot (local) air conditioning.

The air-conditioning apparatus of the present invention is also applicable to a cylindrical duct. In this case, the airflow adjuster 16 is made from a circular thin plate, and slit patterns are arranged concentrically on the plate.

Figure 16:
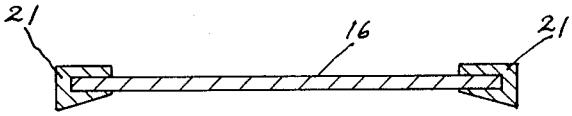
FIG. 16 is a cross-sectional view showing an airflow adjuster provided with a reinforcing frame.
Figure 17:
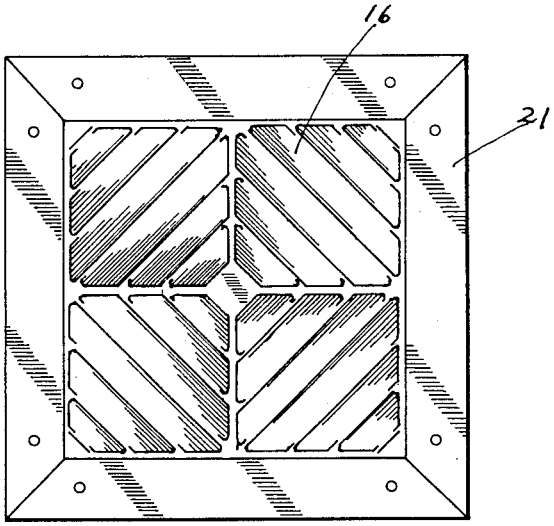
FIG. 17 is a plan view schematically showing the airflow adjuster shown in FIG. 16.

As shown in FIGS. 16 and 17, the periphery of the airflow adjuster 16 may be covered with a reinforcing frame 21 made from a steel plate, plastic material, etc. The reinforcing frame 21 is fixed to the periphery of the airflow adjuster 16 with screws.

By virtue of the reinforcing frame 21, curving deformations on the airflow adjuster 16 which may be caused in an assembling work to the duct member 14 or during a storing period are prevented so that the airflow adjuster 16 is correctly fitted to the positioning section 26.

The present invention is also applicable to a single board ceiling provided with lighting devices and fire alarms.

(Second Embodiment)

The second embodiment of the present invention will be described. In the second embodiment, the same parts as those of the first embodiment will be represented with the same reference marks to omit their explanations.

FIGS. 20 to 24(*a*) through 24(*e*) show embodiments in which the air-conditioning apparatus of the present invention is used as an air-conditioning damper.

Figure 20:
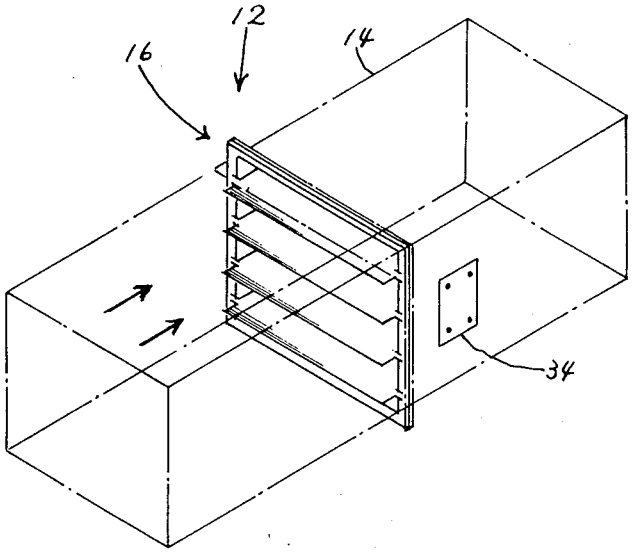
FIG. 20 is a perspective view generally showing an air-conditioning apparatus used as an air-conditioning damper according to a second embodiment of the present invention.

In FIG. 20, an airflow adjuster 16 is arranged in the middle of a duct member 14 across an air guiding passage formed in the duct member 14.

In the vicinity of the airflow adjuster 16, there is disposed an operation port 34 on the side face of the duct member 14. The operation port 34 is covered with a cover which is fixed with screws. The cover of the operation port 34 is opened when a worker manually adjusts vanes 20 to optional angles.

Figure 21:
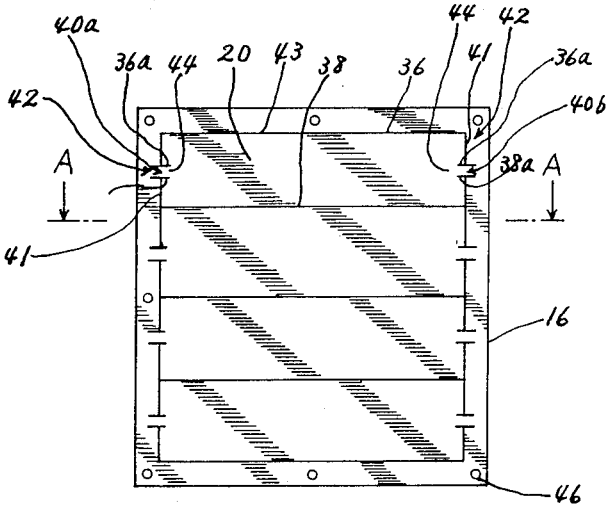
FIG. 21 is a front view showing an airflow adjuster according to the second embodiment.
Figure 22:
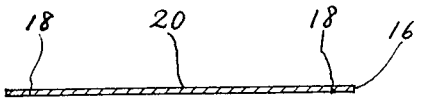
FIG. 22 is a cross-sectional view taken along a line A—A of FIG. 21.

FIGS. 21 and 22 are a front view and a sectional view taken along a line A—A, respectively, showing the airflow adjuster 16 of the embodiment.

The airflow adjuster 16 is formed in a rectangular shape corresponding to a cross-sectional shape of the duct member 14 and made from a single thin plate made of soft steel as in the case of the first embodiment.

As shown in the figures, each vane 20 comprises a first slit segments 41 on opposite sides of the vane 20 and a second slit segments 43 on the other opposite sides of the vane 20. A contour of each vane 20 is defined with two slits 36 and 38 having first slit segments 41 and second slit segments 43 defining two opposite sides of the vane. Both ends of one of the slits are positioned in the vicinity of both ends of the other slit to define two slit-discontinued portions 40*a* and 40*b* on the periphery of the vane 20. Namely, each slit has a channel-like shape, and the channel-like shapes of both the slits are disposed to face each other to constitute the vane configuration. The slit-discontinued portions 40*a* and 40*b* are positioned substantially in the center of the first slit segments 41 defining the opposite two sides of the vane 20.

In this arrangement, the vane 20 is adjustable in its angle around both the slit-discontinued portions 40*a* and 40*b*.

At ends of the respective slits, there are formed extensions 36*a* and 36*b* which are extending in directions approaching to and parting from each other. Accordingly, the slit-discontinued portions 40a and 40b have thin connections 44 respectively which are orthogonal to the first slit segments 41 defining the sides of the vane.

By extending the extensions 36a and 38a in both the directions approaching to and parting from each other at the ends of the slits, the slit-discontinued portions 40a and 40b provide torsional actions.

The length in the approaching direction of each of the extensions 36a and 38a may be formed shorter than that in the parting direction. By doing so, the airflow adjuster 16 may be easily processed, and the slits may be cut with metal dies. If the length in the approaching direction is shorter than the other, torsional plastic deforming portions of the slit-discontinued portions 40a and 40b formed on the air passage side become smaller so that pressure loss is reduced and noises prevented.

The second slit segments 43 defining adjacent vanes consists of only one slit. Therefore, only the vanes 20 interfere with a flow of air. Accordingly, pressure loss in adjusting the airflow is substantially eliminated so that the air quantity is efficiently adjusted.

Each vane 20 may be twisted for at least 180° around the slit-discontinued portions 40a and 40b in an optional direction independently of the other vanes without external driving mechanisms in setting the angle of the vane.

The strength of the slit-discontinued portions 40a and 40b against the torsional rotating actions has been experimentally verified that it stands for about 100 times of torsional actions by virtue of thin connections 44 formed with the slit extensions 36a and 38a. Since dampers for adjusting air quantity are not frequently adjusted once the angles of vanes of the dampers are adjusted, the above-mentioned durability will be sufficient.

The vanes 20 are needed to be rotatable for at least 180° so that stopper mechanisms such as projections may be provided on the side faces of the duct such that the vanes 20 are moved for a fixed range between a totally closed state and a 180° raised state, or thick line marks are drawn on one faces of the vanes in the totally closed state.

After cutting the slits on a thin plate, the thin plate is subjected to a galvanizing process. Therefore, the air quantity adjusting damper has an excellent rust preventive characteristic. The galvanizing process may be carried out at a low cost and easily, compared to the conventional apparatus.

Without an external driving mechanism such as a handle and a warm gear mechanism and without a vane linkage mechanism, the vanes 20 can be adjusted and set to optional angles.

Although the extensions 36a and 38a have been extended in the directions approaching to and parting from each other, they may be extended only outwardly in the parting direction as shown in FIG. 24, or only in the approaching direction.

In this embodiment, the airflow adjuster 16 is formed from a single thin plate made of soft steel on which the slit patterns and the slit-discontinued portions 40a and 40b acting as the supporting shafts of the vanes 20 are formed.

Therefore, the damper apparatus of the present invention does not need a separate damper frame. The airflow adjuster 16 made from the single thin plate can be fitted to an existing duct member so that material costs are remarkably reduced.

The apparatus can be automatically mass-produced so that manufacturing costs are also remarkably reduced.

The damper of the present invention is not provided with vane shaft projections which are usually provided in the prior art apparatus. Therefore, the damper of the present invention realizes low pressure loss to efficiently adjust an air quantity.

Further, the damper is formed from the thin plate so that its weight is remarkably light and not bulky. As a result, the damper is easy to handle, store and transport.

The vanes 20 are integrally fixed to the airflow adjuster 16 so that noises due to plays at bearing portions of the vanes will never be generated.

The damper is easy to fit to the duct and easy to remove from the duct to shorten a work time and eliminate laborsome work.

Even if the slit-discontinued portions acting as the supporting shafts are rusted, the vanes 20 are rotatable and adjustable.

In addition to the patterns mentioned in the above, various patterns and the combination of the patterns may be made on a thin plate to form vanes which are torsionally rotatable around the slit-discontinued portions 40a and 40b. For instance, linear and arcuate slits may be combined with slit patterns such as trapezoidal patterns, triangular patterns or star-like patterns to constitute desired vane shapes.

To arrange the airflow adjuster 16 in the middle of a duct, bolt holes 46 are provided on the periphery of the airflow adjuster 16 as shown in FIG. 21, and the airflow adjuster 16 is fixed to a fitting position of the duct through a packing, etc., with bolts as shown in FIG. 20.

For adjusting angles of the vanes 20, screws for fixing the cover to the operation port 34 are unfastened, and a worker directly adjusts the vanes manually by inserting his hands through the operation port 34.

Figure 23:
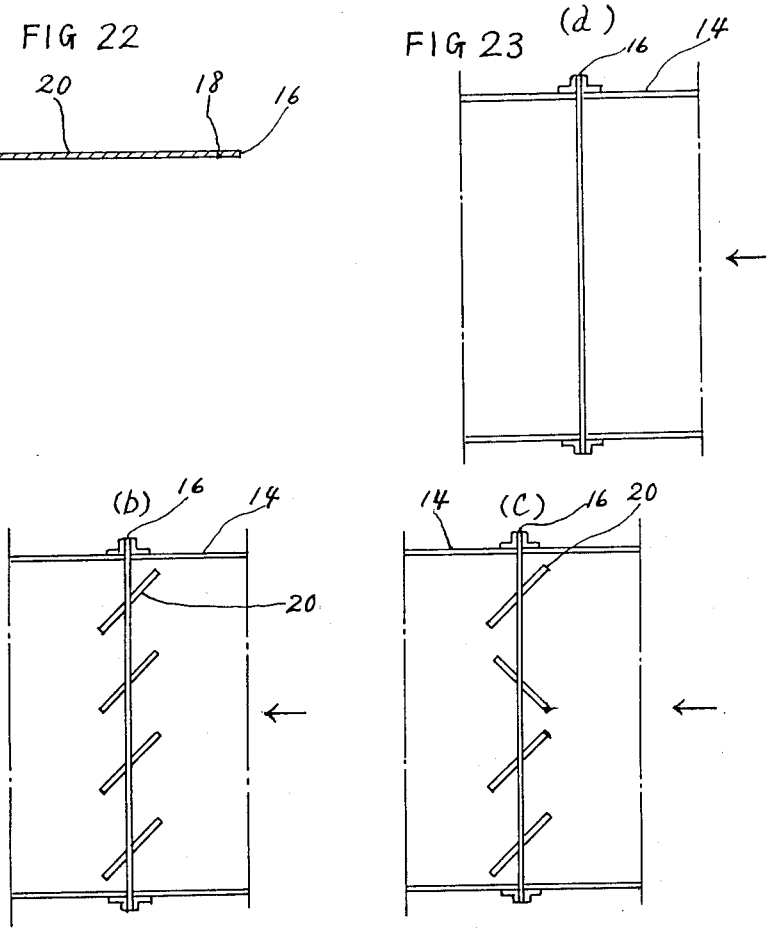
FIGS. 23(*a*) to 23(*e*) are side views showing the airflow adjuster shown in FIG. 21 with vanes raised to various angles.

FIGS. 23(*a*), 23(*b*), 23(*c*) and 23(*d*) are views showing examples of the angles of the vanes 20 separately adjusted. In FIG. 23(*a*), an air passage is totally closed. In FIG. 23(*b*), all the vanes 20 are set at the same angle with respect to an air flowing direction. In FIG. 23(*c*), an air quantity at the upper part of an air passage is suppressed while the air is passed toward a low pressure side in parallel with the air flowing direction, and an air quantity at the lower part of the air passage is suppressed while the air is passed toward the low pressure side along the wall of the duct. In FIG. 23(*d*), the respective vanes 20 are set to optional angles at random.

Particularly as shown in FIG. 23(*b*), the airflow adjuster 16 is constituted from the flat plate with no vane shafts so that pressure loss is extremely reduced.

As shown in FIG. 23(*e*), the periphery of the airflow adjuster 16 can be bent, and the bent portion can be directly fixed to the wall of the duct with bolts. In this case, there is no need to cut part of the duct to provide a flange, or no need to provide a sealing packing so that the airflow adjuster 16 may be disposed at any location in the duct.

Figure 27:
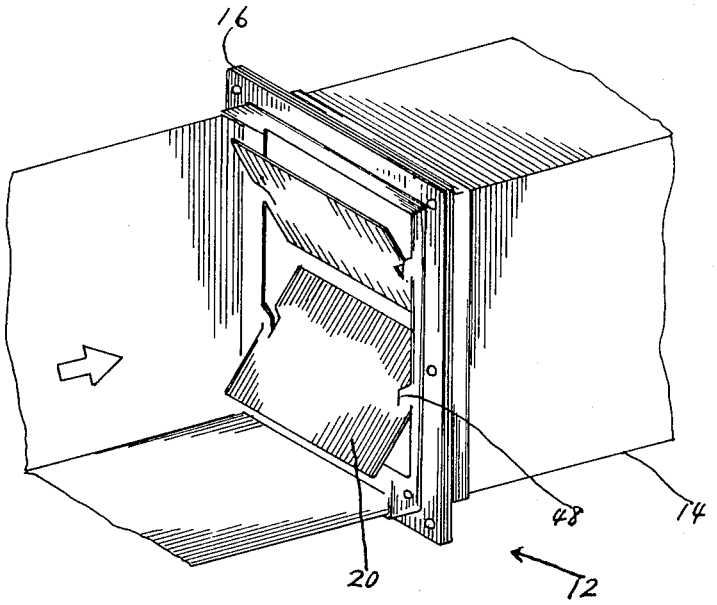
FIG. 27 is a perspective view showing an air-conditioning apparatus with the airflow adjuster of the embodiment 2—2.

FIGS. 26 and 27 show the embodiment 2—2 in which an air-conditioning apparatus 12 of the present invention is used as an air conditioning damper.

In the figures, the same parts as those of the embodiment 2-1 are represented with the same reference marks to omit their explanations.

As apparent in the figures, this embodiment has the same basic constitution as that of the embodiment 2-1. However, ends of one of two slits defining a contour of each vane 20 extend substantially in parallel with first slit segments 41 defining the sides of the vane 20. Slit-discontinued portions 40*a* and 40*b* have thin connections 48 extending substantially in parallel with the first slit segments 41 defining the sides of the vane 20.

Namely, in this embodiment, the thin connections 48 of the slit-discontinued portions 40*a* and 40*b* are disposed in parallel with the first slit segments 41.

Therefore, in setting the angle of each vane 20, the slit-discontinued portions 40*a* and 40*b* are deformed plastically to hold the vane 20 at a proper angle. Other operations of this embodiment are the same as those of the embodiment 2-1.

(Third Embodiment)

Figure 28:
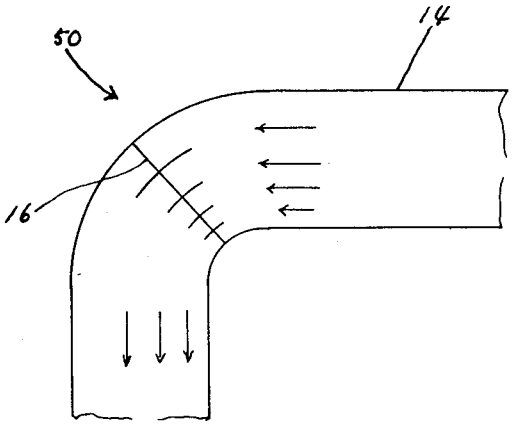
FIG. 28 is an explanatory view showing an arrangement of an air-conditioning apparatus used as a guide vane apparatus according to a third embodiment of the present invention.
Figure 29:
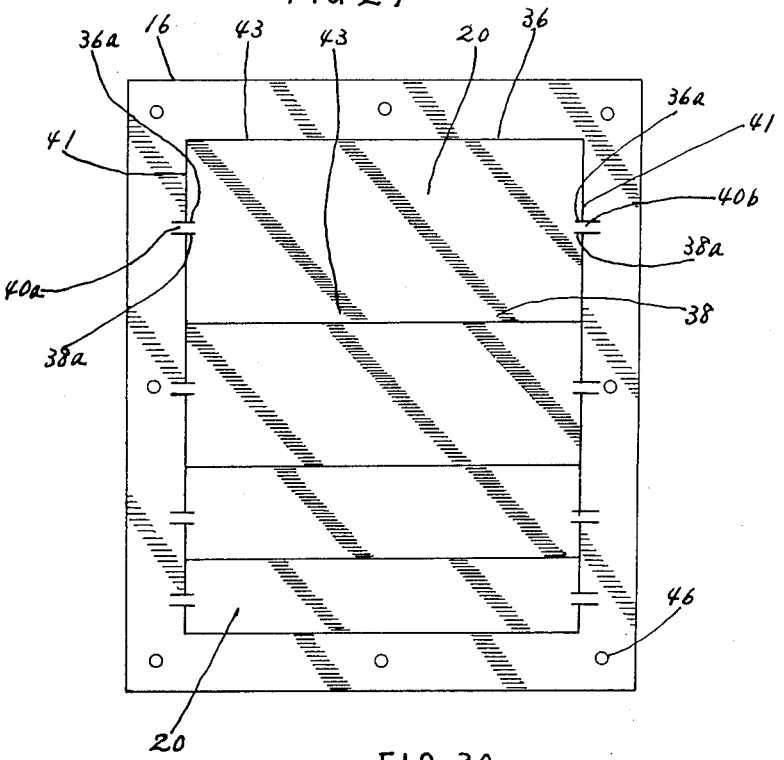
FIG. 29 is a front view showing an airflow adjuster of the third embodiment.
Figure 30:
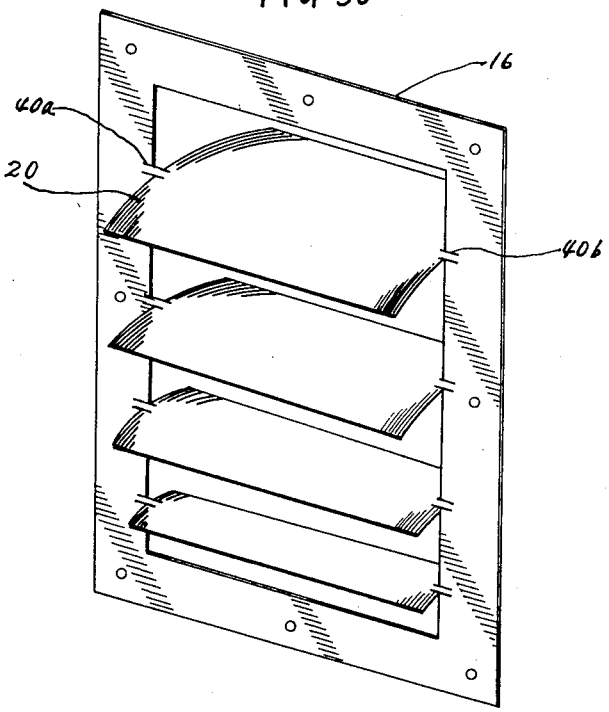
FIG. 30 is a perspective view schematically showing the airflow adjuster of the third embodiment.

FIGS. 28 to 30 show an embodiment in which the air-conditioning apparatus of the present invention is used as a guide vane apparatus. In the figures, the same parts as those of the second embodiment are represented with the same reference marks to omit their explanations.

In FIG. 28, a duct member 14 for forming an air passage has an elbow 50 where an airflow adjuster 16 is disposed with a plurality of vanes 20 to guide and straighten flows of air indicated with arrow marks toward the downstream side.

FIG. 29 is a view showing a thin plate constituting the airflow adjuster 16. As in the cases of the previous embodiments, the thin plate is made of soft steel on which slits are cut by a pressing process, a plasma process or a laser process. The configurations of the patterns are the same as those of the embodiment 2-1.

In this embodiment, the sizes of the thin plate are selected so as to substantially close the air passage of the duct member 14 having a rectangular cross-sectional area. The thin plate is provided with slits to form the vanes 20.

A feature of this embodiment is that first side pairs 41 of the respective vanes 20 have different lengths respectively. The vanes 20 are successively arranged such that a vane having the longest first side pair is disposed at the outermost position of the elbow 50 and the shortest first side pair at the innermost position of the elbow 50. The respective vanes have surfaces curved in the same direction as that of the elbow portion 50.

In this embodiment, there are four vanes 20, and, in the figure, the lengths of the first side pairs become shorter from the top vane toward the bottom vane. The vanes having the longer first side pairs 41 are disposed on the outer side of the air passage to improve a flow straightening effect. The pitches of the vanes 20 and the lengths of the first side edges are optionally set and formed by a laser process, a pressing process or a plasma process so that they may be easily formed.

As shown in FIG. 30, the vanes 20 are curved in arcuate shapes around supporting shaft portions. The curves may be processed with rollers or metallic dies having required curvatures which are pressed against the thin plate shown in FIG. 29. Therefore, the present invention can eliminate bothersome work of the prior art apparatus in which solid guide vanes having curvatures meeting with various conditions are separately formed and fitted to a solid frame and arranged in a duct to meet the curvatures of the duct. The guide vane apparatus of the present invention can be manufactured and disposed to completely satisfy the requirements of the duct.

As described in the above, each vane 20 is bent to a predetermined angle around the slit-discontinued portions 40*a* and 40*b*. On the thin plate, the remains of the vanes 20 form air passages. Air is guided and straightened by the vanes 20 as shown in FIG. 28.

The apparatus as a whole is formed with a single plate. Namely, the apparatus solidly comprises only the airflow adjuster 16 including the vanes 20.

As mentioned in the above, the apparatus as a whole is basically constituted with the single thin plate so that the apparatus is easily assembled to the duct through a spacer, etc., even if thickness margins are not sufficient.

On the inner periphery of the airflow adjuster 16, there are formed a plurality of bolt holes 46, and the airflow adjuster 16 is connected to a connection portion of the elbow 50 with bolts.

Fixing brackets may be provided on the thin plate in advance, and the brackets may be fitted to the inner wall of the duct.

To assemble the airflow adjuster 16 to the duct member 14 as shown in FIG. 28, the vanes 20 are curved in arcuate shapes around the supporting shaft portions as described in the above, and the slit-discontinued portions 40*a* and 40*b* are curved to predetermined angles to realize vane angles which satisfy various requirements of the duct. The first side pairs 41 are arranged on the outer routing side.

In the figures, an airflow rate on the inner routing side is slow while that of the outer routing side is relatively high. Therefore, differences in the flow rates tend to cause disturbance. Particularly on the inner routing side, static pressure becomes large to influence adjacent airflows. To cope with this, a bending pitch is made smaller on the inner routing side to regulate influential force orthogonal to an airflow. Namely, by guiding the air in an advancing direction with the vanes 20, the air is effectively straightened.

The vanes 20 may be formed in ellipses, if they sufficiently catch and straighten flows of air.

In addition, extensions may be formed at ends of the slit to extend in a direction parting from each other as shown in FIG. 24 to obtain the same effect as that of the second embodiment by forming thin connections.

(Fourth Embodiment)

FIGS. 31 to 35 show an air-conditioning apparatus to be used as a supply outlet as well as an air-conditioning damper. In the figures, the same parts as those of the first and second embodiments are represented with the same reference marks to omit their explanations.

Figure 31:
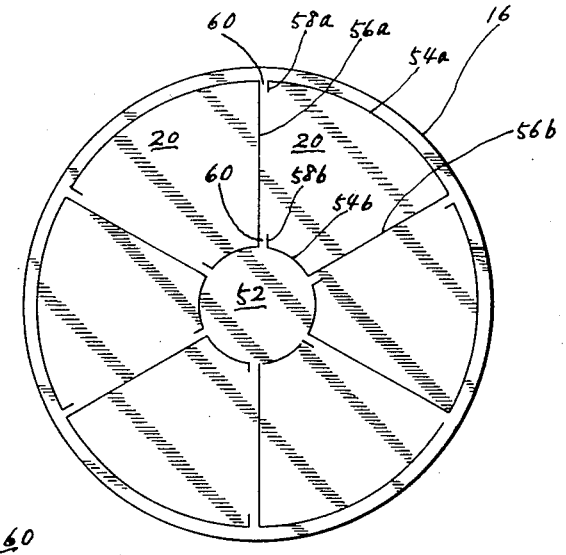
FIG. 31 is a front view showing an airflow adjuster according to an embodiment 4-1 of the present invention.

FIG. 31 is a front view showing an airflow adjuster 16 of an air-conditioning apparatus 12 according to an embodiment 4-1. As in the previous embodiments, the airflow adjuster 16 is made from a thin plate of soft steel on which slits are cut to define a plurality of vanes 20.

The vanes 20 are disposed radially around a center portion 52.

The contour of each vane 20 is defined with a single slit and formed in a sector having two arcuate portions 54*a* and 54*b* and two linear portions 56*a* and 56*b*.

Both ends of the single slit are arranged in the vicinity of and along one of the linear portions. Extensions 58*a* and 58*b* having predetermined lengths are formed at both the ends of the slit and extended in parallel with the linear portions 56*a* and 56*b* of the adjacent vanes 20. Between the extensions 58*a* and 58*b* and the linear portions 56a and 56b, there is formed a slit-discontinued portion 60 having a predetermined length.

The slit-discontinued portion 60 constitutes a supporting shaft portion of the sector. Supposing the linear portion 56b is pushed to raise the vane 20 around the slit-discontinued portion 60, the slit-discontinued portion 60 is torsionally deformed to raise the vane. The remain of each vane 20 forms an air vent 62.

Figure 32:
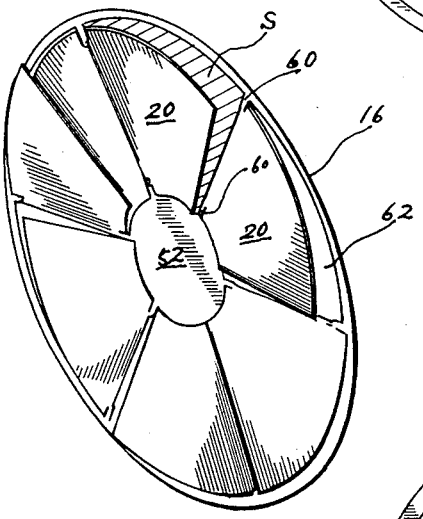
FIG. 32 is a view explaning an operation of the airflow adjuster shown in FIG. 31.

As shown in FIG. 32, a sectional opening S is formed between the periphery of the vane 20, the center portion 52 and the two linear portions 56a and 56b. An area of the sectional opening S changes depending on a slant angle of the vane 20 so that the air flow rate can be changed by changing the angle of the vane 20. As in the cases of the previous embodiments, when the vanes 20 are raised, the slit-discontinued portions 60 are torsionally deformed but not bent acutely so that they will not break easily. According to experiments, the vanes 20 can be repeatedly raised to right angles in 100 odd times.

A required length of the slit-discontinued portion 60 is selected to provide strength such that excessive force is not applied to members when the slit-discontinued portion 60 is torsionally deformed. Due to a shape of the slit-discontinued portion 60 after the torsional deformation, the slit-discontinued portion is strengthened and stabilized.

Figure 33:
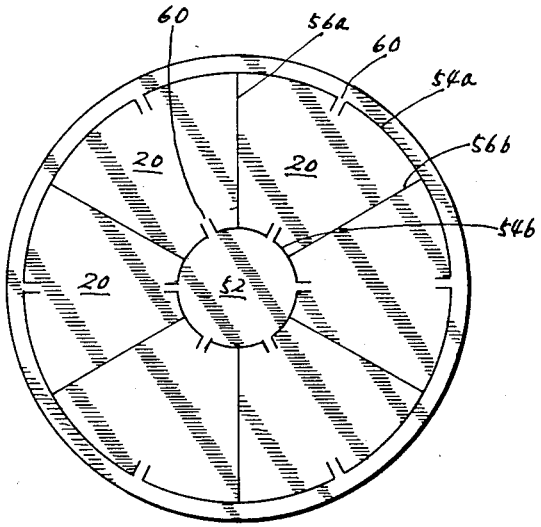
FIG. 33 is a front view showing an airflow adjuster according to an embodiment 4-2 of the present invention.

FIG. 33 is a front view showing an airflow adjuster according to an embodiment 4-2 of the present invention. In the figure, a contour of each vane 20 is defined with two slits to form a sector having two arcuate portions 54a and 54b and two linear portions 56a and 56b. At ends of the two slits, there are slit-discontinued portions 60 on the two arcuate portions 54a and 54b respectively. The slit-discontinued portions 60 form supporting shaft portions of the vanes 20. The linear portions 56a and 56b of the adjacent two vanes 20 are defined with a common single slit.

Namely, the two linear portions 56a and 56b commonly define the linear portions of the adjacent vanes 20.

Therefore, in this embodiment, not like the embodiment 4-1, when the airflow adjuster 16 is arranged in the duct member 14, the vanes 20 are the only areas which interfere with an air passage of the duct member 14 so that pressure loss at the supporting shaft portions is negligible, and the adjustment of the quantity and direction of air can be carried out efficiently.

Figure 34:
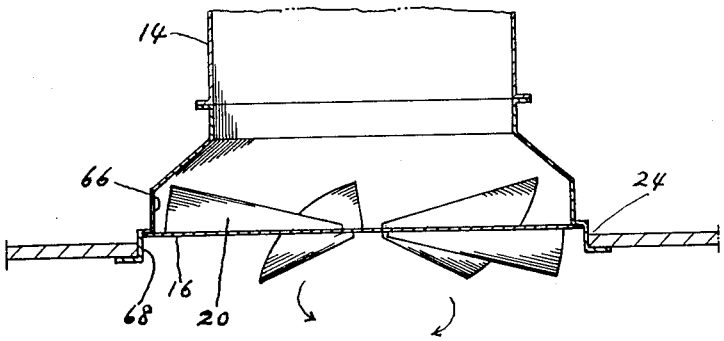
FIG. 34 is an explanatory view schematically showing the airflow adjuster used as a supply outlet according to the fourth embodiment.

When the air-conditioning apparatus of the fourth embodiment is used as a supply outlet as shown in FIG. 34, the airflow adjuster 16 is fitted to a positioning section 68 of a conical opening portion 66 of a cylindrical duct member 14.

In this case, a direction of supplied air is gradually changed whirlingly so that an airflow as a whole rotates. Therefore, supplied air and room air are quickly mixed to promote uniformity in a room temperature to realize a preferable air-conditioning effect.

Figure 35:
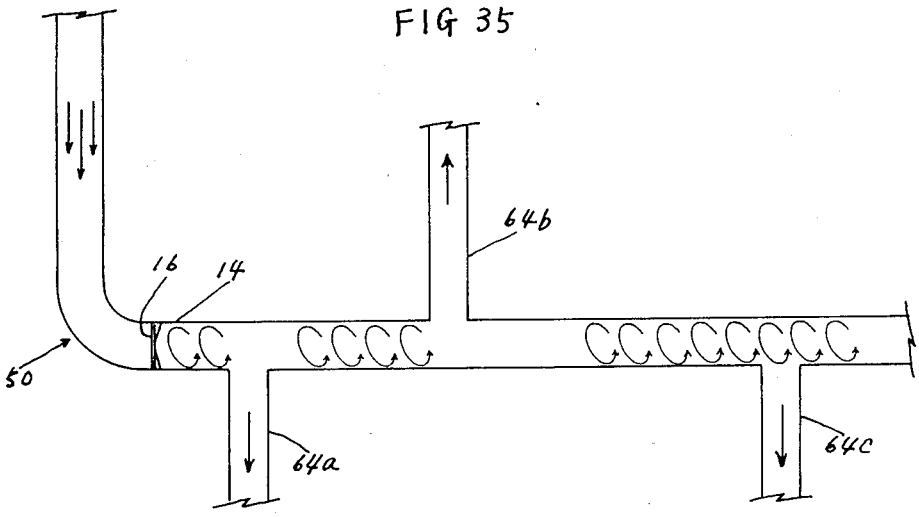
FIG. 35 is a view showing an arrangement of the airflow adjuster used as a damper according to the fourth embodiment.

When the air-conditioning apparatus of the fourth embodiment is used as a damper as shown in FIG. 35, the airflow adjuster 16 is placed on the downstream side of an elbow 50 of a duct member 14 in the vicinity of the elbow 50, and, following the airflow adjuster 16, there are connected branch duct groups 64a, 64b, 64c and so on. Flows of air are given rotational movements so that force toward a wall of the duct is averaged. If the airflow adjuster 16 is not provided, air passing through the duct member 14 is faster on the outer side with respect to a curve of the elbow 50 so that a large quantity of air is distributed to the branch duct 64a, while the air is relatively slow on the inner side so that a small quantity of air is distributed to the branch ducts 64b and 64c.

By providing the airflow adjuster 16, air is easily branched at the branching positions of the duct, and the air is evenly distributed to the left and right branch ducts to improve an air-conditioning effect.

(Fifth Embodiment)

With reference to FIGS. 36 to 39, an operation port apparatus for an air-conditioning damper is described. In the figures, the same parts as those of the second embodiment will be represented with the same reference marks to omit their explanations.

Figure 36:
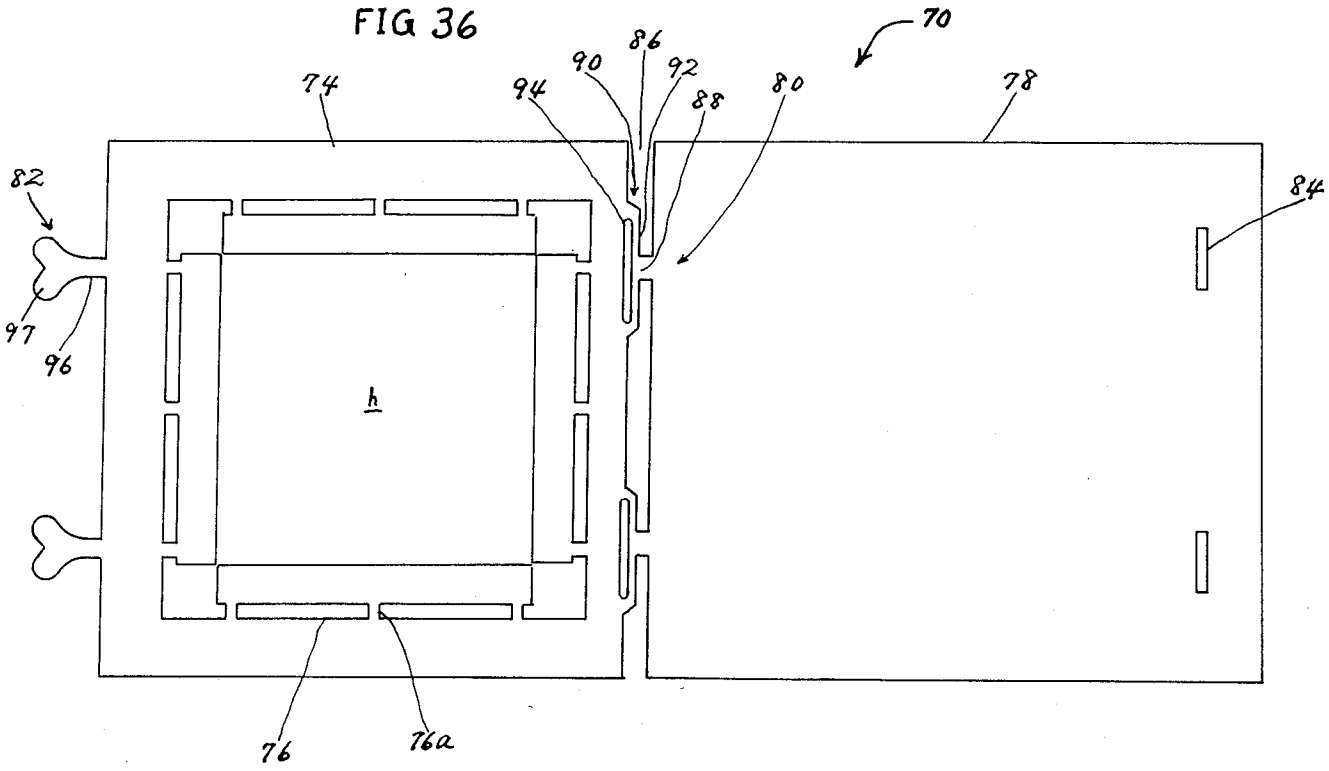
FIG. 36 is a view generally showing the constitution of an operation port apparatus according to an embodiment 5-1.

FIG. 36 is a general view schematically showing an operation port apparatus 70 according to an embodiment 5-1 of the present invention.

The operation port apparatus 70 is provided to a duct member acting as an air passage and in the vicinity of an air-conditioning damper. The air-conditioning damper is disposed in the air passage of the duct member and includes vanes. The vanes are independently rotatable around supporting shaft portions without an external driving mechanism such as a handle and a gear mechanism and adjustable to optional angles.

The air-conditioning damper with the airflow adjuster with the vanes independently rotatable to optional angles without the external driving mechanism may be constituted with a frame of the damper and separate vanes. At the supporting shaft portions of the vanes, there are disposed engaging pins and receiving portions engaged to each other. Under a predetermined engaged state, the vanes are separately rotated to required angles.

In this embodiment, the airflow adjuster 16 of the second embodiment in which slits are formed on a single thin plate to integrally form vanes is disposed in the duct member 14.

The operation port apparatus 70 comprises an opening 72 formed on a wall of the duct member 14, and a closure device 73 fixed to the opening 72 to open and close the opening 72. The closure device 73 comprises a frame body 74 having an operation port h corresponding to the opening 72, fixing portions 76 connected to the frame body 74 to fix the frame body 74 to the opening 72, a cover body 78 connected to the frame body 74 to open and close the operation port h of the frame body 74, hinge portions 80 connected to the frame body 74 and the cover body 78, tabs 82 connected to the frame body 74, and long holes 84 formed on the cover body and into which the tabs 82 are inserted.

The closure device 73 is made in one body with a single thin plate of soft steel processed with a laser unit, a plasma unit, or a press.

The opening 72 is rectangular, and at least one is formed on the wall surface of the duct member 14. On the periphery of the opening 72, there is arranged the closure device 73.

The frame body 74 is formed in a rectangular shape to surround the operation port h corresponding to the rectangular opening 72 formed on the wall of the duct 14. The frame body 74 is provided with the long plate-like fixing portions 76 which project from respective sides of the operation port h. With three thin connections 76a on each of the sides of the operation port h, the fixing portions 76 are connected to the frame body 74. To fix the frame body 74 to the duct wall, the fixing portions 76 are easily bent toward the duct wall to fix the closure device 73 to the opening 72 of the duct 14.

Adjacent to the frame body 74, there is formed the cover body 78 to cover the operation port h of the frame body 74. The frame body 74 and the cover body 78 are connected to each other with the two hinge portions 80.

Each hinge portion 80 comprises a small connection 88 which disconnects a notch 86 dividing the thin plate into the frame body 74 and the cover body 78 and connects the frame body 74 and the cover body 78 to each other, a long projection 90 protruding from the frame body 74 and connected to the small connection 88, and a long hole 94 formed substantially in the center of the long projection 90 to form a thin connection 92 with respect to an end of the long projection 90. By virtue of the thin connection 92 of each hinge portion 80, there will be no breakage even if the cover body 78 is repeatedly opened and closed, rather the strength is increased due to the torsional motions. It has been proved in experiments that the hinge portions 80 are not broken up to about 200 times of pivotal motions. The longer the thin connection 92 of each hinge portion in a longitudinal direction, the larger the durability against the torsional motions.

In this embodiment, the long projection 90 is formed on the frame body 74, and the long hole 94 substantially in the center thereof. Here, an essentially member is the thin connection 92 which rotates torsionally. Therefore, without providing the long projection 90, the long hole 94 may be provided on the frame body 74 orthogonal to the small connection 88 and connected to the small connection 88.

On the frame body 74 and substantially opposite to the hinge portions 80, there are projectingly formed the tabs 82 each comprising a neck portion 96 and a tab portion 97. On the cover body 78 and substantially corresponding to the hinge portions 80, there are cut long holes 84 at the other ends of the cover body 78. The tabs 82 are raised, the cover body 78 being bent at the hinge portions 80, and the tabs 82 are inserted to the long holes 84. After that, the tabs 82 are twisted to lock the totally closed state of the opening 72. This structure shown in FIG. 36 is integrally formed from a single soft steel plate by a laser process, a plasma process, or a press process.

The reverse side of the frame body 74 shown in FIG. 36 is coated with adhesives (not shown) while the front side thereof is provided with a packing (not shown) made of glass wool, etc.

To dispose the closure device 73 on the opening 72 formed on the wall of the duct, the operation port h of the frame body 74 is aligned with the opening 72. The frame body 74 is adhered to the duct wall, and the fixing portions 76 are bent for about 180° toward the duct wall and fixed. Accordingly, the fixation is carried out with no screws. Particularly due to the plastic holding force of the fixing portions 76 cooperating with the adhesive force of the adhesives, the fixation is securely carried out. Therefore, the fitting work is easy to perform.

Figure 37:
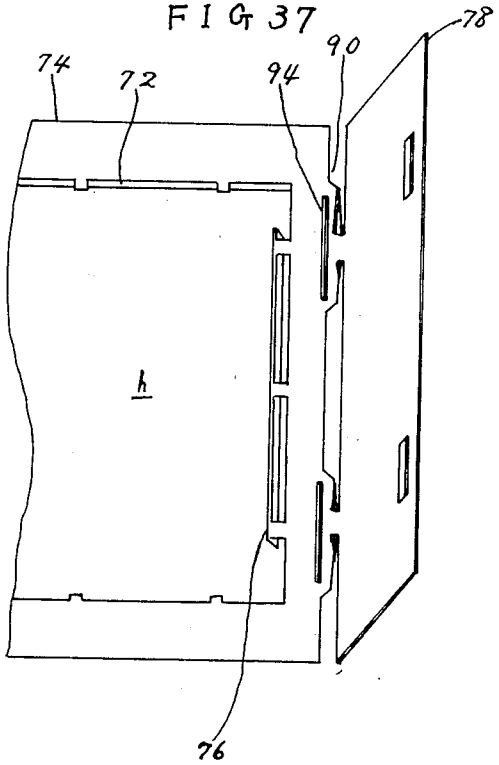
FIG. 37 is an explanatory view showing an open and close operation of a cover body of the operation port apparatus.

To open the cover body 78, the thin connections 92 of the hinge portions 80 are torsionally rotated to open the operation port with no members such as screws, as shown in FIG. 37. Namely, when the cover body 78 is bent to close or open the opening 72, the thin connections 92 are rotated torsionally in a left or a right screw direction at the ends of the small connections 88. The frame body 74 and the cover body 78 with the hinge portions 80 are formed in one body so that the cover body 78 is stopped at an optional angle due to the torsional plastic holding force of the thin connections 92. Therefore, the cover body 78 will not move to bother a worker who manually adjusts angles of the vanes of the damper.

Figure 38:
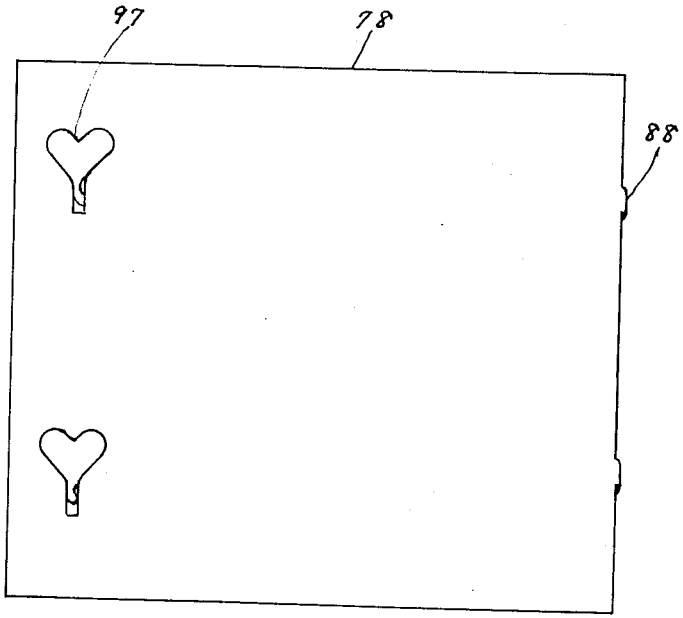
FIG. 38 is a view showing the operation port apparatus with the cover body entirely closed.

The tabs 82 are raised, the cover body 78 bent at the hinge portions 80, and the tabs 82 inserted to the long holes 84. Then the tabs 82 are twisted to lock the totally closed state of the opening 72 as shown in FIG. 38.

Figure 39:
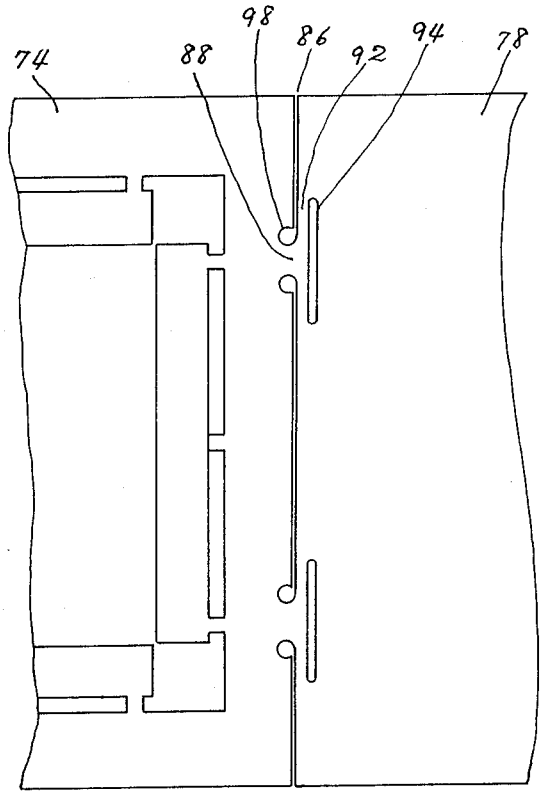
FIG. 39 is a view showing part of an operation port apparatus according to an embodiment 5-2 of the present invention.

An embodiment 5-2 of the operation port apparatus 70 will be described with reference to FIG. 39. In the figure, the same parts as those of the embodiment 5-1 are represented with the same reference marks to omit their explanations.

According to this embodiment, each of hinge portions 80 comprises a small connection 88 which connects a frame body 74 to a cover body 78 while disconnecting a notch 86 dividing a thin plate into the frame body 74 and the cover body 78, a long hole 94 formed on the cover body 78 and disposed along and adjacent to the small connection 88 to form a thin connection 92 with respect to ends of the notch 86, and escaping notches 98 provided on the frame body 74 and connected to the ends of the notch 86.

In this embodiment, when the cover body 78 is opened and closed, the thin connections 92 and the escaping notches 98 will bear torsional movements.

The operation port apparatus 70 of the present invention is not limited by the above-mentioned embodiments. If the operation port has another shape such as a circle or a triangle, the frame body and the cover body may be formed corresponding to the shape of the operation port. The number of the hinge portions may be one or more than three to achieve the same effect.

By constituting the operation port apparatus in the above way from a single thin plate, the frame body, cover body, hinge portions, etc., are formed in one body so that the structure will be simple, the number of parts reduced, a fitting work simplified, costs reduced, and vane angles adjusted easily by opening the cover body and fixing the cover body at the open position.

What is claimed is:

1. An air-conditioner apparatus for adjusting the direction and quantity of air, comprising:
   - a duct means for providing an air guiding passage extending through said duct means;
   - an airflow adjusting means for adjusting a flow of air, fitted to said duct means across said air guiding passage and made from a single thin plate;
   - slits of predetermined patterns formed on said airflow adjusting means; and
   - a plurality of vanes defined with said slits and formed integral to said airflow adjusting means, each vane having first slit segments defining opposed sides of the vane and second slit segments defining other opposed sides of the vane and slit-discontinued portions disposed in the center of said first slit segments such that said vane is adjustable around said slit-discontinued portions to optional angles.

2. An air-conditioning apparatus as claimed in claim 1 and used as an air-conditioning damper, wherein an operation port is provided to said duct means in the vicinity of said airflow adjusting means, angles of said vanes being directly adjustable manually through said operation port.

3. An air-conditioning apparatus as claimed in claim 1, wherein both ends of one of said two slits defining said vane extend substantially in parallel with said first slit segments defining said two opposite sides of said vane, and said slit-discontinued portions have thin connections respectively, said thin connections extending substantially in parallel with said first slit segments.

4. An air-conditioning apparatus as claimed in claim 3, wherein the lengths of said first side pairs of said respective vanes are different from each other.

5. An air-conditioner as in claim 1 wherein extension approaching each other and extensions parting from each other are provided at both ends of said two slits, and said slit-discontinued portions have thin connections respectively, said thin connections being orthogonal to said first slit segments.

6. An air-conditioner as in claim 1 wherein said second slit segments defining adjacent vanes consists of only one slit.

* * * * *